US007569116B2

(12) United States Patent
Ono et al.

(10) Patent No.: US 7,569,116 B2
(45) Date of Patent: Aug. 4, 2009

(54) CO-CR-MO-BASED ALLOY AND PRODUCTION METHOD THEREFOR

(75) Inventors: Yoshiki Ono, Yokohama (JP); Masashi Sakamoto, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 306 days.

(21) Appl. No.: 11/350,090

(22) Filed: Feb. 9, 2006

(65) Prior Publication Data

US 2006/0185770 A1 Aug. 24, 2006

(30) Foreign Application Priority Data

Feb. 24, 2005 (JP) ..... 2005-049549

(51) Int. Cl.
*C22C 19/07* (2006.01)
*C22C 1/10* (2006.01)

(52) U.S. Cl. ..... 148/425; 420/436; 148/674

(58) Field of Classification Search ..... None
See application file for complete search history.

(56) References Cited

U.S. PATENT DOCUMENTS

| | | | | |
|---|---|---|---|---|
| 3,865,585 | A | 2/1975 | Rademacher | |
| 4,116,724 | A * | 9/1978 | Hirschfeld et al. | 148/674 |
| 4,446,579 | A | 5/1984 | Inamori et al. | |
| 4,465,515 | A * | 8/1984 | Mundorff | 75/243 |
| 4,660,755 | A | 4/1987 | Farling et al. | |
| 5,462,575 | A * | 10/1995 | Del Corso | 75/243 |
| 5,732,469 | A | 3/1998 | Hamamoto et al. | |
| 5,904,720 | A * | 5/1999 | Farrar et al. | 623/22.15 |
| 6,187,045 | B1 * | 2/2001 | Fehring et al. | 623/11.11 |
| 2004/0221926 | A1 * | 11/2004 | Chiba et al. | 148/425 |
| 2004/0236433 | A1 | 11/2004 | Kennedy et al. | |
| 2006/0210826 | A1 * | 9/2006 | Wu et al. | 428/689 |

FOREIGN PATENT DOCUMENTS

| | | |
|---|---|---|
| EP | 1 466 991 A1 | 10/2004 |
| JP | A 2002-363675 | 12/2002 |
| JP | A-2002-363675 | 12/2002 |

* cited by examiner

*Primary Examiner*—John P. Sheehan
(74) *Attorney, Agent, or Firm*—Oliff & Berridge, PLC

(57) ABSTRACT

A Co—Cr—Mo-based alloy includes: 63 mass %≦Co<68 mass %; 15 mass %≦Cr<26 mass %; 10 mass %≦Mo<19 mass %; and the balance of inevitable impurities, wherein the total amount of Cr and Mo is from 32 mass % to 37%. The mass magnetic susceptibility of the alloy is $7\times4\pi\cdot10^{-9}$ $m^3/kg$ or less at room temperature, and the Vickers hardness number (Hv) of the alloy is 400 or more.

4 Claims, 3 Drawing Sheets

CO-CR-MO-BASED ALLOY AND PRODUCTION METHOD THEREFOR

BACKGROUND OF THE INVENTION

1. Field of the Invention

The present invention relates to a Co—Cr—Mo-based (=cobalt-chromium-molybdenum-based) alloys and to a production method therefor. In particular, the present invention relates to a production technique for a Co—Cr—Mo-based alloy which can be used for medical implantation devices, for example, prosthetic materials for artificial aggregates, prosthetic implantation parts, artificial hip joints, and materials for joining and fixing bones. The present invention relates to a production technique for a Co—Cr—Mo-based alloy which is superior in compatibility with a living body, corrosion resistance, and wear resistance, and a low magnetic susceptibility which does not exert harmful effects on MRI (=magnetic resonance image) for medical examination diagnosis.

2. Description of Related Art

In examinations of medical images, due to problems of radiation sickness by X-rays exposure, MRI (=magnetic resonance image) is widely used instead of X-ray image. In a case in which an alloy having a high magnetic susceptibility is embedded in a living body of a patient and the patient is set in an MRI apparatus, an image of the living body is obtained by the MRI apparatus. However, in this case, an image of a periphery of a member of the above alloy is distorted or cannot be obtained due to magnetic flux generated from the alloy. As a result, an examination of the MRI or a diagnosis from the MRI (hereinafter "MRI diagnosis") is difficult.

In medical implantation devices, a Co—Cr—Mo-based (=cobalt-chromium-molybdenu-based) alloy is used as an alloy which is superior in compatibility with a living body, corrosion resistance, and wear resistance. In the future, corrosion resistance and wear resistance of Co—Cr—Mo-based alloys must be improved. However, for example, members of the ASTM (=American Society for Testing and Materials) standard have a high magnetic susceptibility, and thereby are inconvenient for MRI diagnosis.

In a Co—Cr—Mo-based alloy, corrosion resistance and wear resistance are improved remarkably by increasing the amount of included Mo and homogenizing the structure of the Co—Cr—Mo-based alloy. However, plastic workability greatly decreases due to a Mo-rich phase which is hard and brittle is segregated as a second phase, such that working stress increases, or cracking occurs in the second phase. Recently, a melted alloy including Co, 26 to 30 mass % of Cr, 6 to 12 mass % of Mo, and 0 to 0.3 mass % of C is subjected to quench casting in water-cooling copper die, so that a material is obtained. The material is subjected to hot forging so as to have a second phase which is controlled to be finely dispersed in grains having an average diameter of 50 μm or less. As a result, plastic workability of the material is improved (see Japanese Unexamined Patent Application Publication No. 2002-363675).

However, since the composition of the material includes a composition of the ASTM standard, the material of the above composition is estimated to have as high a magnetic susceptibility as those of conventional techniques, and an MRI of a member of the above material is distorted or cannot be obtained. Besides, the hardness of the above composition is estimated to be the same as those of conventional techniques. Due to this, in a case in which the material is used for implanting devices like a ball joint, required wear resistance on a sliding surface thereof cannot be obtained.

SUMMARY OF THE INVENTION

The present invention was made in consideration of the above problems. An object of the present invention is to provide a Co—Cr—Mo-based alloy which has a low magnetic susceptibility and is reliably wear resistant in order to prevent an image of a member thereof obtained by an MRI from being distorted, to get an image of a periphery of a member thereof, and to be sufficiently wear resistant with respect to bones or the like.

According to one aspect of the present invention, a Co—Cr—Mo-based alloy includes: 63 mass %≦Co<68 mass %; 15 mass %≦Cr<26 mass %; 10 mass %≦Mo<19 mass %; the balance of inevitable impurities, wherein the total amount of Cr and Mo is from 32 mass % to 37%. The mass magnetic susceptibility of the alloy is $7\times4\pi\cdot10^{-9}m^3/kg$ or less at room temperature and the Vickers hardness number (Hv) of the alloy is 400 or more. The above mass magnetic susceptibility may be measured by using a vibrating sample type magnetometer.

According to a preferred embodiment, the Co—Cr—Mo-based alloy further includes: a granulated region containing Mo which is dispersed in a matrix at a concentration higher than that in the matrix in an internal structure having a 100 μm square in a free selected cross section thereof. The granulated region may have a length of 15 μm or less and an area ratio of 5% or less of the granulated region with respect to the matrix. According to another preferred embodiment, the Co—Cr—Mo-based alloy further includes a crystal structure other than a face centered cubic (=fcc) structure and a hexagonal close packed (=hcp) structure in the granulated region.

According to another aspect of the present invention, a production method for a Co—Cr—Mo-based alloy includes: heating to a temperature of 1200 to 1300 degrees C. for at least 3 hours in an inert atmosphere.

In an aspect of the present invention, the composition of the Co—Cr—Mo-based alloy and the heating conditions are appropriately controlled, the alloy can have a good magnetic susceptibility and a good Vickers hardness. As a result, the alloy can be used in MRI without exerting harmful effects thereon. The alloy can be sufficiently wear resistant as sliding members.

DESCRIPTION OF THE PREFERRED EMBODIMENTS

Figure 1:
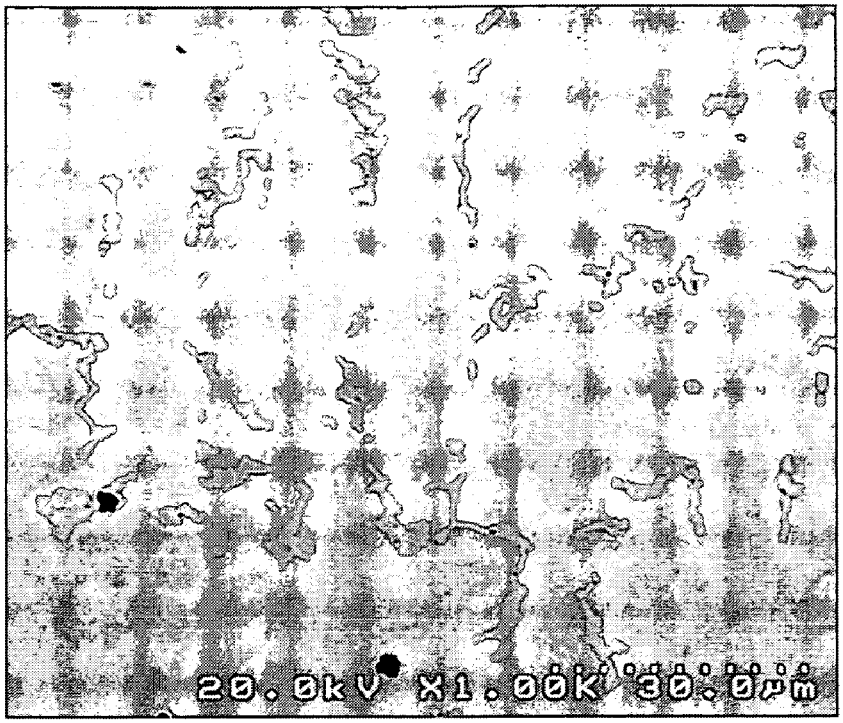
FIG. 1 is a reflecting electron (composition) image in SEM of an internal structure of an as-cast material which is a precursor of the Example 1 of an alloy of the present invention.

A preferred embodiment of the present invention will be described in detail hereinafter.

A Co—Cr—Mo-based alloy of the present invention was made in order to prevent an image of a member thereof obtained by MRI from being distorted and to obtain an image of a periphery of a member thereof as described above. The Co—Cr—Mo-based alloy has a low magnetic susceptibility and is reliably wear resistant. Conventionally, in studies on mass magnetic susceptibility and Vickers hardness number (Hv) of a Co—Cr—Mo-based alloy of the ASTM Standard which was difficult to use in MRI diagnosis, the Co—Cr—Mo-based alloy having a mass magnetic susceptibility of $8.0\times4\pi\cdot10^{-9}$ $m^3/kg$ or less did not have a Hv of 400 or more. The Vickers hardness is used as a wear resistance scale. Therefore, both the lower mass magnetic susceptibility and the higher Vickers hardness of a Co—Cr—Mo-based alloy have been required. That is, one aspect of the present invention provides a Co—Cr—Mo-based alloy which has a low mass magnetic susceptibility and high hardness, wherein the mass magnetic susceptibility thereof is $7.0\times4\pi\cdot10^{-9}$ $m^3/kg$ or less and the Hv thereof is 400 or more.

Generating magnetism in crystal materials is based on not only the magnetic moment of each atom constituting crystal, but greatly also the interactions thereof with adjacent atoms. Due to this, in a case in which crystals have the same structures, that is, adjacent atoms have the same position relationships, in order to reduce the mass magnetic susceptibility in the Co—Cr—Mo based alloy system, it is effective that the amount of included Co which has the highest atomic magnetic moment (that is, which has the highest atomic magnetic susceptibility) of component elements in the alloy be reduced as much as possible. Therefore, the inventors researched the reduction in the amount of Co included in the alloy, and researched the increase in the amount of Cr and Mo included in the alloy.

As a result, as the amount of Co included in the alloy was reduced, the mass magnetic susceptibility of the alloy was reduced, and results supporting the ideas of the inventors were obtained. However, it was confirmed that in a case in which the amount of Cr and Mo exceeded a predetermined value in the alloy, the mass magnetic susceptibility thereof increased again. In as-cast materials and cast materials subjected to various working and/or heat treatment, the mass magnetic susceptibility thereof increased again in the above manner; however, the absolute values of the mass magnetic susceptibility thereof were different in the material state (the as-cast materials were the highest in the mass magnetic susceptibility).

However the reason why the mass magnetic susceptibility increased again in the above manner is not known, according to the results of microscopic examination, analysis of X-ray diffraction pattern, X-ray microanalysis, analysis of electron backscatter diffraction pattern, in internal structures of alloys of the present invention, it was confirmed that area of Mo-rich region increased with respect to a matrix having an fcc structure or an hcp structure, and the Mo-rich region included a phase of complicated structures other than an fcc structure and an hcp structure, wherein the phase may be selected from a group consisting of σ-phase of CoCr compound structure, R-phase of $Co_5Cr_2Mo_3$ compound structure, and μ-phase of $Co_7Mo_6$ compound structure.

In the above manner, the reason that the mass magnetic susceptibility increases again is described in the following (1) to (3). That is, (1) In a region (matrix) adjacent to a Mo-rich region, Mo concentration decreases, and a Co concentration which has the highest atomic magnetic susceptibility of component elements increases. (2) A phase of a complicated crystal structure in the Mo-rich region is high in magnetic susceptibility. (3) Multiplier effects by the above (1) and (2) are obtained.

Therefore, it is conceived that a structure of which Co concentration is as low as possible and in which Mo-rich region is as small as possible is preferable for decreasing the mass magnetic susceptibility. For example, it was confirmed that in an internal structure having a 100 μm square in an arbitrary cross section, a Mo-rich region is dispersed in a matrix, a granulated region containing Mo at a concentration thereof higher than that of a matrix has a length 15 μm or less, and an area ratio of the granulated region with respect to the matrix is 5% or less, so that mass magnetic susceptibility of a Co—Cr—Mo-based alloy is $7.0\times4\pi\cdot10^{-9}$ $m^3/kg$ or less can be obtained. For example, it was confirmed that the granulated region has a crystal structure other than an fcc structure and an hcp structure, so that mass magnetic susceptibility of a Co—Cr—Mo-based alloy can be more a preferable value.

Based on the above findings, the limitation reason for the composition ratio of the respective elements of a first aspect (=the claim 1 of the claims) of the present invention is as follows.

(1) Limitation reasons for the lower limit of the amount of included Co (63 mass % or more) and for the upper limit of the amount of included Mo (less than 19 mass %)

The above limitations are for preventing increase in phases of complicated crystal structures (for example, σ-phase, R-phase, μ-phase, or the like) other than an fcc structure or an hcp structure, the complicated crystal structures being considered as high in mass magnetic susceptibility. The above limitations are for preventing increase in mass magnetic susceptibility due to increase in a Co concentration in the matrix due to the increase in Mo-rich region.

(2) Limitation reason for the lower limit of included Co (less than 68 mass %)

Since Co is highest in atomic magnetic susceptibility of component elements, the amount of included Co is as small as possible, and the amount of included Co is 68 mass % or less, the mass magnetic susceptibility at room temperature can be $7\times4\pi\cdot10^{-9}$ $m^3/kg$ or less.

(3) Limitation reason for the lower limit of the amount of included Mo (10 mass % or more)

The lower limit of the amount of included Mo is 10 mass % or more, so that the Vickers hardness number (Hv) which is an index of wear resistance can be maintained at 400 or more.

(4) Limitation reason for the lower limit of the amount of included Cr (15 mass % or more)

The lower limit of the amount of included Cr is 15 mass % or more, so that the Vickers hardness which is an index of wear resistance can be maintained at 400 or more without decreasing corrosion resistance which is approximately equal to that of conventional material.

(5) Limitation reason for the upper limit of the amount of included Cr (less than 26 mass %)

The upper limit of the amount of included Cr is less than 26 mass %, so that increase in the mass magnetic susceptibility due to increase in a phase (in particular, σ-phase) of a complicated crystal structure can be prevented, the complicated crystal structure being other than an fcc structure or an hcp structure.

Next, a production method of the Co—Cr—Mo-based alloy of the present invention will be described in detail. Whatever cast materials are used as starting materials, whether or not various working processes are performed after casting is not important. However, in order to obtain the mass magnetic susceptibility, the Vickers hardness, the length, and the area ratio of the granulated region, and the crystal structure characterized in first to third aspects (the claims 1 to 3 of the claims) of the present invention, the heat treating conditions in a fourth aspect (the claim 4 of the claims) of the present invention are required in processing of the production method. That is, in the first aspect of the present invention, a Co—Cr—Mo-based alloy includes: 63 mass %≦Co<68 mass %; 15 mass %≦Cr<26 mass %; 10 mass %≦Mo<19 mass %; and the balance of inevitable impurities, wherein the total amount of Cr and Mo is from 32 mass % to 337%. The mass magnetic susceptibility of the alloy is $7\times4\pi\cdot10^{-9}$ $m^3/kg$ or less at room temperature, and the Vickers hardness number (Hv) of the alloy is 400 or more. In the second aspect of the present invention, the Co—Cr—Mo-based alloy further includes: a granulated region containing Mo which is dispersed in a matrix at a concentration higher than that in the matrix in an internal structure having a 100 μm square in a free selected cross section thereof, wherein the granulated region has a length of 15 μm or less and an area ratio of 5% or less of the granulated region with respect to the matrix. In the third aspect of the present invention, the Co—Cr—Mo-based alloy further includes a crystal structure other than a face centered cubic structure and a hexagonal close packed structure in the granulated region. In the fourth aspect of the present invention, the production method for a Co—Cr—Mo-based alloy includes heating to a temperature of 1200 to 1300 degrees C. for at least 3 hours in an inert atmosphere. In a case in which common casting was performed or water-cooling mold was used in casting, an alloy (before heat treating) having a composition of the present invention had a dendrite structure having high unevenness of the concentration, and had also distortion generated in cooling. Due to this, the alloy did not satisfy the mass magnetic susceptibility and the Vickers hardness in the first aspect of the present invention. Due to this, it is effective to homogenize the alloy by heat treating. However, in this case, unless the heat treating is performed on the alloy in an inert atmosphere, Cr and Mo are diffused to a surface of the alloy, and are formed into oxides thereof. Due to this, Co concentration in the matrix increases, and the magnetic susceptibility increases. Therefore, it is necessary to perform the above heat treating in an inert atmosphere.

In a case in which the above heat treating is performed at less than 1200 degrees C. for less than 3 hours, Mo-rich region is large, the length thereof exceeds 15 μm, and phases of crystal structures other than an fcc structure and an hcp structure increase. In a case in which a temperature in the above heat treating exceeds 1300 degrees C., partial melting starts in the alloy, unevenness of concentration is easily generated, and a large region of Mo-rich phase is easily reprecipitated, the alloy does not satisfy a preferable range of the mass magnetic susceptibility and the Vickers hardness in the first aspect of the present invention. Therefore, the above heat treating is preferably performed at 1200 to 1300 degrees C. for at least 3 hours or more in an inert atmosphere.

EXAMPLES

Effects of the present invention will be explained by the examples in detail hereinafter.

Example 1 of the Alloy of the Present Invention

Figure 2:
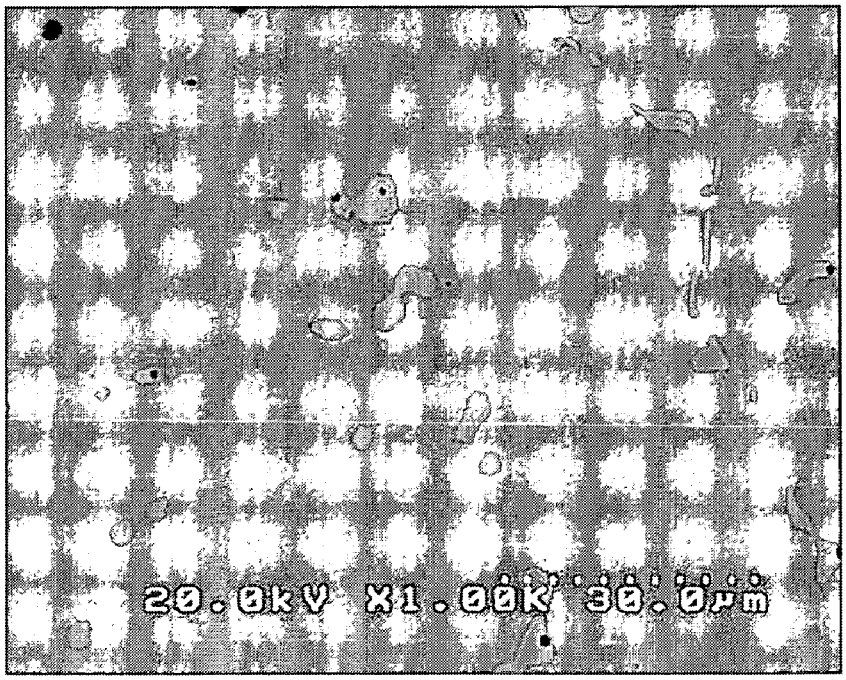
FIG. 2 is a reflecting electron (composition) image in SEM of an internal structure of the Example 1 of the alloy of the present invention.

An as-cast material made by compounding and alloying 19 mass % of Cr, 16 mass % of Mo, and the balance of Co and inevitable impurities satisfied requirements of the composition in the first aspect of the present invention. However, the as-cast material had a Vickers hardness number (average of five measurement points) of 360 and a mass magnetic susceptibility of $10.8\times4\pi\cdot10^{-9}$ $m^3/kg$ at room temperature, and had a dendrite structure having high unevenness of concentration. FIG. 1 is a reflecting electron (composition) image in SEM of an internal structure of the as-cast material. As shown in FIG. 1, an image at Mo-rich region of 100 $\mu m^2$ in cross section is bright, and the area ratio thereof with respect to the matrix was alomost 8%. The as-cast material was subjected to heat treating at 1200 degrees C. for 3 hours in an Ar atmosphere, so that Example 1 of the alloy of the present invention was obtained. FIG. 2 is a reflecting electron (composition) image in SEM of an internal structure of the Example 1 of the alloy of the present invention. As shown in FIG. 2, the area ratio of the Mo-rich region (region which appears to be bright) with respect to the matrix was reduced to 2%. The Example 1 of the alloy of the present invention had a Vickers hardness number (average of five measurement points) of 495 and a mass magnetic susceptibility of $5.9\times4\pi10^{-9}$ $m^3/kg$ at room temperature. All reflecting electron (composition) images in SEM show a structure after corrosion. In FIG. 2, the brighter the region, the higher Mo concentration is in the region. In FIG. 2, some black spots denote etch pits.

Example 2 of the Alloy of the Present Invention

Figure 3:
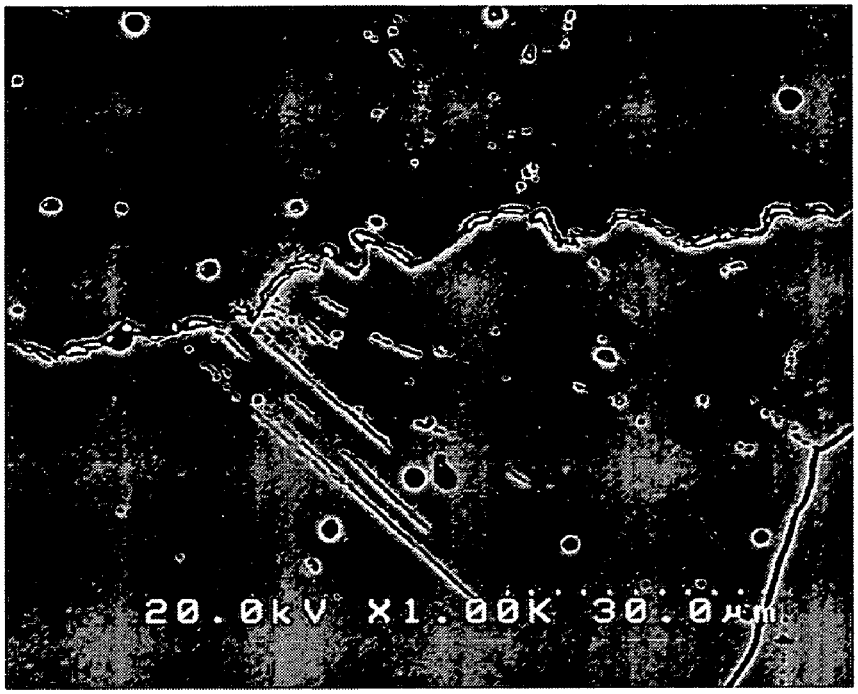
FIG. 3 is a reflecting electron (composition) image in SEM of an internal structure of the Example 2 of the alloy of the present invention.

An as-cast material made by compounding and alloying 23 mass % of Cr, 12 mass % of Mo, and the balance of Co and inevitable impurities satisfied requirements of the composition in the first aspect of the present invention. The as-cast material was subjected to heat treating at 1200 degrees C. for 3 hours in an Ar atmosphere, so that the Example 2 of the alloy of the present invention was obtained. FIG. 3 is a reflecting electron (composition) image in SEM of an internal structure of the Example 2 of the alloy of the present invention. As shown in FIG. 3, a Mo-rich region (region which appears to be bright) was very small, and the area ratio thereof with respect to a matrix was 0.2%. The Example 2 of the alloy of the present invention had a Vickers hardness number (average of five measurement points) of 520 and a mass magnetic susceptibility of $6.2\times4\pi\cdot10^{\times9}$ $m^3/kg$ at room temperature.

Comparative Example 1 of the Alloy

An as-cast material made by compounding and alloying 24 mass % of Cr, 8 mass % of Mo, and the balance of Co and inevitable impurities did not satisfy requirements of the composition in the first aspect of the present invention. The as-cast material had a Vickers hardness number (average of five measurement points) of 360 and a mass magnetic susceptibility of $11.1\times4\pi\cdot10^{-9}$ $m^3/kg$ at room temperature. The as-cast material was subjected to heat treating at 1200 degrees C. for 3 hours in an Ar atmosphere, so that Comparative Example 1 of the alloy was obtained. The Comparative Example 1 of the alloy had the almost same Vickers hardness as the above cast material and a mass magnetic susceptibility of $8.5\times4\pi\cdot10^{-9}$ $m^3/kg$ at room temperature, which did not satisfy the first aspect of the present invention. This is because the Co concentration in the matrix was high since the amount of Mo included in the alloy was small.

Comparative Example 2 of the Alloy

An as-cast material made by compounding and alloying 71 mass % of Cr, 19 mass % of Mo, and the balance of Co and inevitable impurities did not satisfy requirements of the composition in the first aspect of the present invention. The as-cast material was subjected to heat treating at 1200 degrees C. for 3 hours in Ar atmosphere, so that Comparative Example 2 of the alloy was obtained. Since the Co concentration in the matrix was high, the Comparative Example 2 of the alloy had a mass magnetic susceptibility of $8.8\times4\pi\cdot10^{-9}$ $m^3/kg$ at room temperature, which did not satisfy the first aspect of the present invention.

Comparative Example 3 of the Alloy

Figure 4:
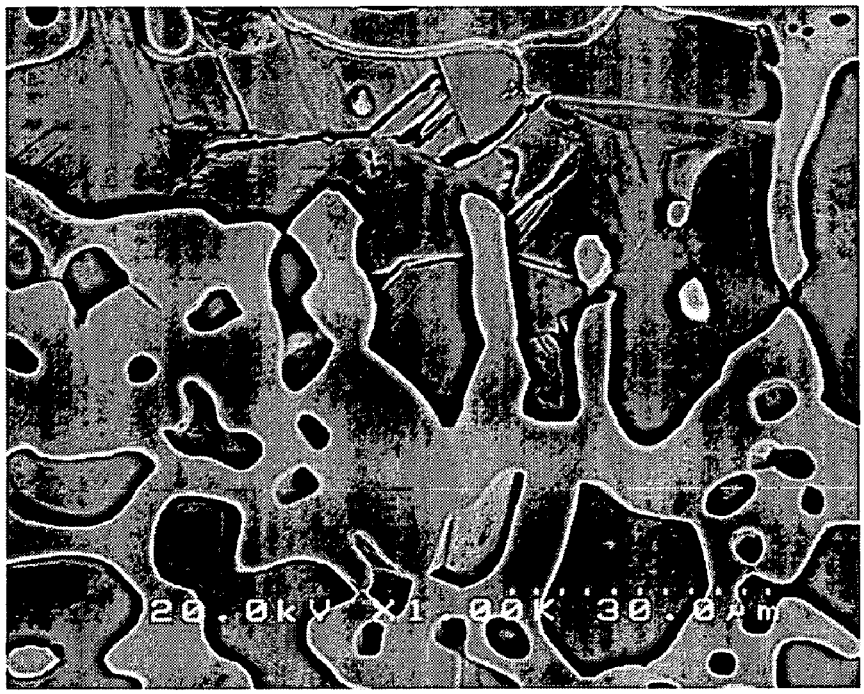
FIG. 4 is a reflecting electron (composition) image in SEM of an internal structure of the Comparative Example 3 of the alloy.

An as-cast material made by compounding and alloying 29 mass % of Cr, 16 mass % of Mo, and the balance of Co and inevitable impurities did not satisfy requirements of the composition in the first aspect of the present invention. The cast material was subjected to heat treating at 1200 degrees C. for 3 hours in an Ar atmosphere, so that Comparative Example 3 of the alloy was obtained. Since in the Comparative Example 3 of the alloy, the Mo-rich region was large, the area ratio of Mo-rich region with respect to the matrix was 44%. FIG. 4 is a reflecting electron (composition) image in SEM of an internal structure of the Comparative Example 3 of the alloy. The Comparative Example 3 of the alloy had a mass magnetic susceptibility of $8.5\times4\pi\cdot10^{-9}$ $m^3/kg$ at room temperature, which did not satisfy the first aspect of the present invention.

Group of the alloys of the present invention

Figure 5:
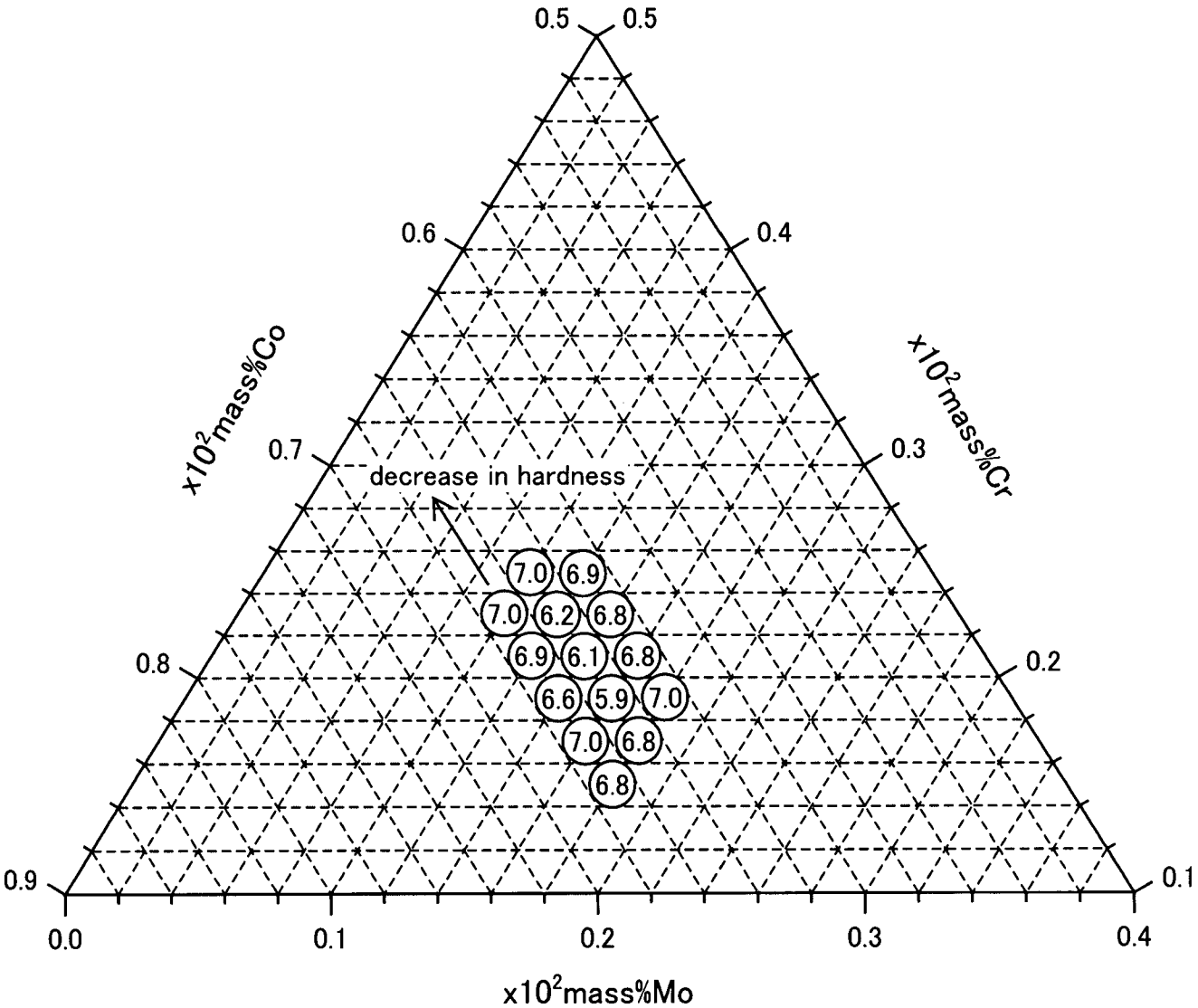
FIG. 5 is a diagram showing mass magnetic susceptibility (units $[4\pi\cdot10^{-9}\ m^3/kg]$) of alloys at room temperature after heat processing in an Ar atmosphere at a temperature of 1200 degrees C. for 3 hours by varying a composition of each alloy within a composition range of the ratios of the present invention.

Alloys of the present invention were made by compounding and alloying Cr, Mo, and the balance of Co and inevitable impurities into cast materials, and performing heat treating on the cast materials at 1200 degrees C. for 3 hours in an Ar atmosphere, wherein each ratio of Co, Cr, and Mo included in the alloys was within a composition range of the ratios of the present invention. FIG. 5 shows the mass magnetic susceptibility of the alloys at room temperature. The mass magnetic susceptibility is calculated by expression of ((numeral marked by a circle in FIG. 5)$\times(4\pi\cdot10^{-9}$ $m^3/kg)$). As shown in FIG. 5, each alloy which satisfies the composition range of Co, Cr, and Mo characterized in the claim 1 and heating treating conditions characterized in the claim 4 had the mass magnetic susceptibility of $7\times4\pi\cdot10^{-9}$ $m^3/kg$ or less. In the triangle shown in FIG. 5, if the amount of Mo is 8 mass % or more, the Vickers hardness of the heat-treated alloy by the fourth aspect of the present invention is 400 or more, and it was confirmed that each alloy of the present invention satisfies these conditions, thereby having a good hardness.

As described above, in an aspect of the present invention, the composition of the Co—Cr—Mo-based alloy and the heating conditions are appropriately controlled, the alloys can have a good mass magnetic susceptibility and a good Vickers hardness. As a result, an image of a member thereof obtained by MRI can be prevented from being distorted, and an image of a periphery of a member thereof can be obtained. The alloys can be sufficiently wear resistant as sliding members. Therefore, it is promising that the alloys of the present invention can be used for medical implantation devices.

What is claimed is:

1. A Co—Cr—Mo-based alloy comprising:

63 mass %≦Co<68 mass %;

15 mass %≦Cr<26 mass %;

10 mass %≦Mo<19 mass %; and the balance of inevitable impurities;

wherein the total amount of Cr and Mo is from 32 mass % to 37%, and the alloy was subjected to a heat treatment at a temperature of from 1200 to 1300 degrees C. for at least 3 hours in an inert atmosphere, whereby the mass magnetic susceptibility of the alloy is $7\times4\pi\cdot10^{-9}m^3/kg$ or less at room temperature, and the Vickers hardness number (Hv) of the alloy is 400 or more.

2. The Co—Cr—Mo-based alloy according to claim 1, the Co—Cr—Mo-based alloy further comprising:

a granulated region containing Mo which is dispersed in a matrix at a concentration higher than that in the matrix in an internal structure having a 100 μm square in a free selected cross section thereof, wherein the granulated region has a length of 15 μm or less and an area ratio of 5% or less of the granulated region with respect to the matrix.

3. The Co—Cr—Mo-based alloy according to claim 2, the Co—Cr—Mo-based alloy further comprising a crystal structure other than a face centered cubic structure and a hexagonal close packed structure in the granulated region.

4. A production method for the Co—Cr—Mo-based alloy of claim 1, comprising:

heating the alloy to a temperature of 1200 to 1300 degrees C. for at least 3 hours in an inert atmosphere.

* * * * *